US009510070B2

(12) United States Patent
Li et al.

(10) Patent No.: US 9,510,070 B2
(45) Date of Patent: Nov. 29, 2016

(54) WEARABLE ELECTRONIC DEVICE

(71) Applicant: Chiun Mai Communication Systems, Inc., New Taipei (TW)

(72) Inventors: Shang-Ying Li, New Taipei (TW); Ching-Ming Hung, New Taipei (TW)

(73) Assignee: Chiun Mai Communications Systems, Inc., New Taipei (TW)

( * ) Notice: Subject to any disclaimer, the term of this patent is extended or adjusted under 35 U.S.C. 154(b) by 36 days.

(21) Appl. No.: 14/587,372

(22) Filed: Dec. 31, 2014

(65) Prior Publication Data

US 2015/0245120 A1 Aug. 27, 2015

(30) Foreign Application Priority Data

Feb. 21, 2014 (TW) ..... 103203033

(51) Int. Cl.
*H04R 1/02* (2006.01)
*H04R 1/28* (2006.01)

(52) U.S. Cl.
CPC *H04R 1/02* (2013.01); *H04R 1/28* (2013.01); *H04R 2499/11* (2013.01); *H04R 2499/15* (2013.01)

(58) Field of Classification Search
CPC ..... H04R 2499/11; H04R 1/28; H04R 1/02
See application file for complete search history.

(56) References Cited

U.S. PATENT DOCUMENTS

2014/0064037 A1* 3/2014 Alameh ..... G04G 21/08 367/199

* cited by examiner

*Primary Examiner* — Simon King
(74) *Attorney, Agent, or Firm* — Zhigang Ma

(57) ABSTRACT

A wearable electronic device includes a band, a gas inlet member, and a gas outlet member. The band defines a sound chamber. The gas inlet member and the gas outlet member are both positioned on the band and communicated with the sound chamber. When the gas inlet member is pressed, air enters into the sound chamber and the sound chamber expands to an expanded state. When the gas outlet member is pressed, the air is exhausted from the gas outlet member and the sound chamber restores to an original state.

13 Claims, 3 Drawing Sheets

WEARABLE ELECTRONIC DEVICE

CROSS-REFERENCE TO RELATED APPLICATIONS

This application claims priority to Taiwanese Patent Application No. 103203033 filed on Feb. 21, 2014, the contents of which are incorporated by reference herein.

FIELD

The subject matter herein generally relates to wearable electronic device, and particularly to a wearable electronic device with a loudspeaker.

BACKGROUND

Wearable electronic devices, such as smart watches or electronic rings, commonly include a loudspeaker for implementing a multi-media playing function. To minimize the size of the wearable electronic device, the loudspeaker is commonly positioned at a band of the wearable electronic device. Then, the volume of the loudspeaker is not high and cannot satisfy the requirement of the user.

BRIEF DESCRIPTION OF THE DRAWINGS

Implementations of the present technology will now be described, by way of example only, with reference to the attached figures.

DETAILED DESCRIPTION

Figure 1:
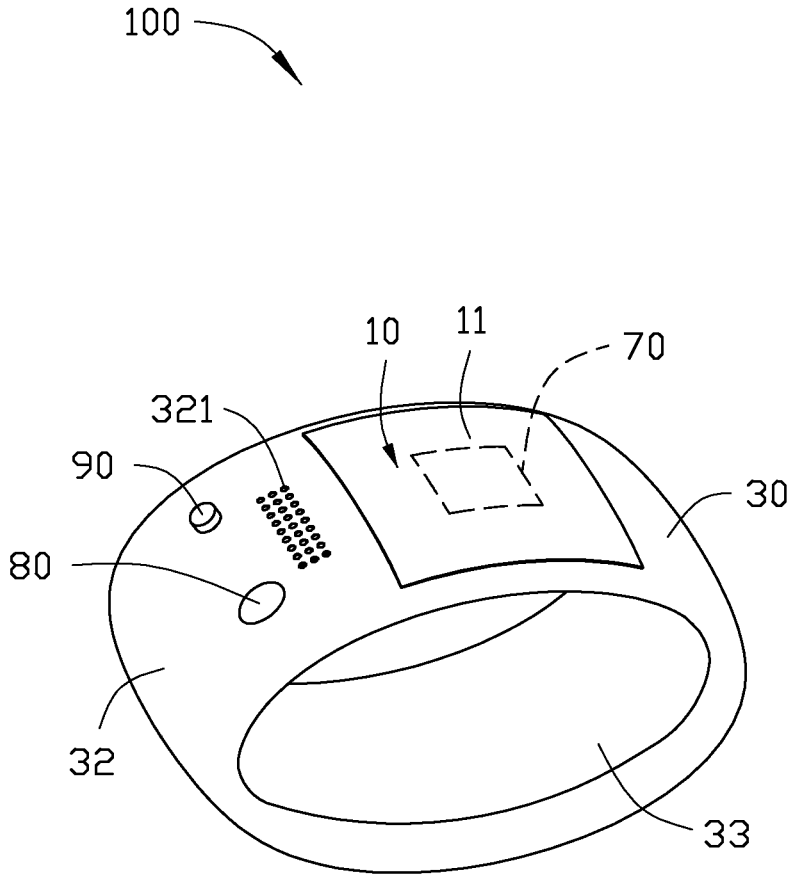
FIG. 1 is an isometric view of an embodiment of a wearable electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wearable electronic device 100. The wearable electronic device 100 may be a smart watch, an electronic ring, or the like. In this embodiment, the wearable electronic device 100 is a smart watch, which can implement functions of an ordinary watch and a mobile phone, for example, displaying time or implementing a multi-media playing function. The wearable electronic device 100 includes a dial 10, a band 30, a loudspeaker 50 (shown in FIG. 2), a control unit 70, a gas injection member 80, and a gas exhaust member 90.

The dial 10 is configured to implement functions of the wearable electronic device 100, such as displaying time or implementing the multi-media playing function. The dial 10 includes a display unit 11. In this embodiment, the display unit 11 is a touch panel. A user can operate the wearable electronic device 100 via the display unit 11.

The band 30 is coupled to the dial 10 and is configured to attach or couple the wearable electronic device 100 to a wrist of the user. In this embodiment, the band 30 is substantially a closed loop-shaped structure and can be made of an elastic material. The band 30 includes a first wall 32 and a second wall 33. The dial 10 is embedded at the first wall 32. The second wall 33 is spaced apart from the first wall 32. A sound chamber 35 (shown in FIG. 2) is formed between the first wall 32 and the second wall 33. The first wall 32 adjacent to the dial 10 defines a plurality of sound holes 321.

Figure 2:
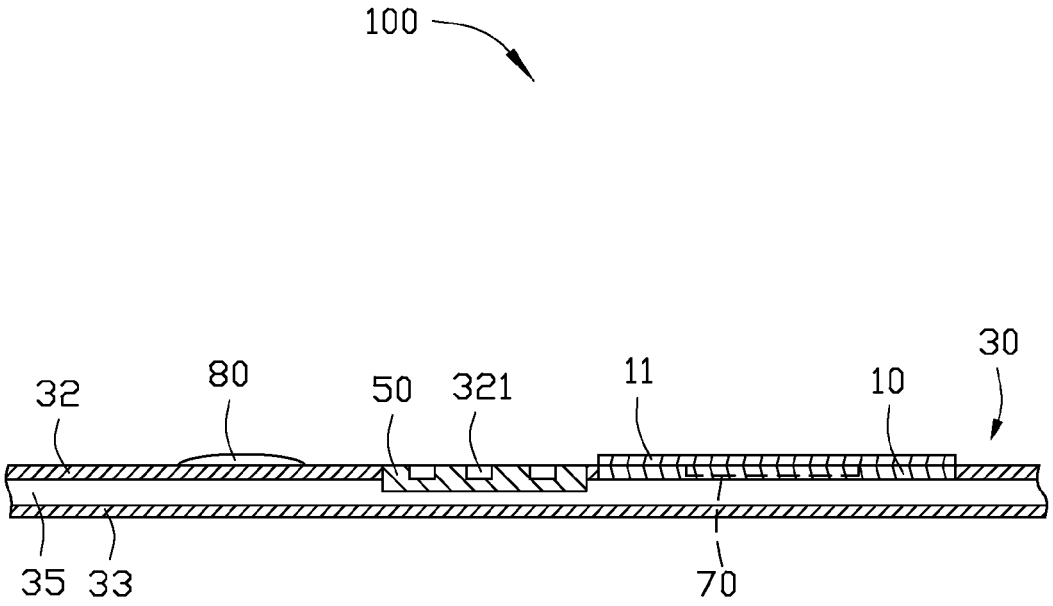
FIG. 2 is a cross-sectional view of the wearable electronic device of FIG. 1, showing a sound chamber of the wearable electronic device of FIG. 1 in an original state.

FIG. 2 illustrates that the loudspeaker 50 is located at one side of the first wall 32 adjacent to the second wall 33 and is aligned with the sound holes 321. Sound emitted by the loudspeaker 50 is transmitted to the sound chamber 35, resonates in the sound chamber 35, and is output from the sound holes 321.

The control unit 70 is positioned at an interior of the band 30 and is electrically connected to the display unit 11 and the loudspeaker 50. The control unit 70 is configured to control the display unit 11 to display time, control the loudspeaker 50 to implement the multi-media playing function, and the like.

In this embodiment, the gas injection member 80 is positioned on the first wall 32 and is in communication with the sound chamber 35. When the gas injection member 80 is pressed, air enters into the sound chamber 35. The sound chamber 35 is gradually expanded and filled with air. Then, a distance between the first wall 32 and the second wall 33 becomes larger so that the sound from the loudspeaker 50 is spread in the expanded sound chamber 35 and then output from the sound holes 321, thereby improving the volume of the sound from the loudspeaker 50.

In this embodiment, the gas outlet member 90 is positioned on the first wall 32 and is also in communication with the sound chamber 35. When the gas outlet unit 90 is pressed, the air in the sound chamber 35 is exhausted from the gas outlet member 90. Then, the sound chamber 35 restores to an original state.

Figure 3:
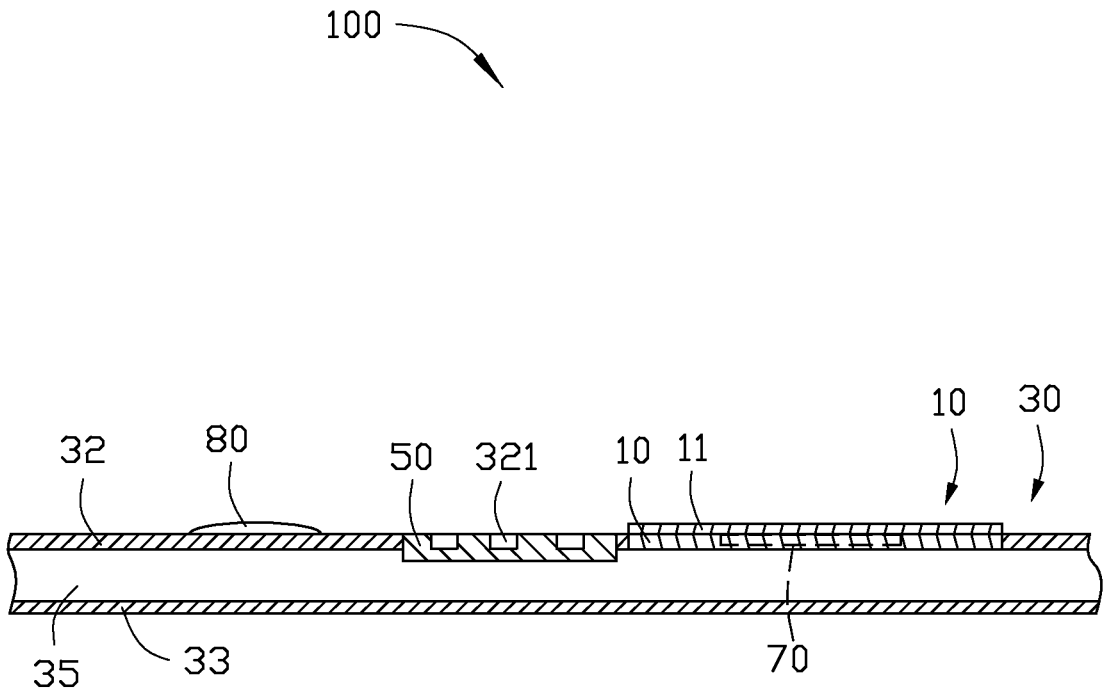
FIG. 3 is similar to FIG. 2, but showing the sound chamber of the wearable electronic device of FIG. 1 in an expanded state.

In use, the sound chamber 35 is not filled with air, and the wearable electronic device 100 is in the original state. Referring to FIG. 3, when the user needs the wearable electronic device 100 to implement the multi-media displaying function, the gas inlet member 80 is pressed. Then, air enters into the sound chamber 35 and the sound chamber 35 is expanded so that a distance between the first wall 32 and the second wall 33 becomes larger. Thus, the sound from the loudspeaker 50 is spread in the expanded sound chamber 35 and is further output from the sound holes 321, thereby improving the volume of the sound from the loudspeaker 50.

When the user needs to close the multi-media playing function, the gas outlet member 90 is pressed until the air in the sound chamber 35 is exhausted from the gas outlet member 90. Then, the sound chamber 35 restores to the original state.

In other embodiments, the wearable electronic device 100 can include two loudspeakers 50 and two groups of sound holes 321. One loudspeaker 50 corresponds to and is aligned with a plurality of sound holes 321.

In other embodiments, the wearable electronic device 100 can include two bands 30. One end of the two bands 30 is coupled to the dial 10. The other end of the two bands 30 is coupled to each other through a latching structure or the like.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wearable electronic device comprising:

a band defining a sound chamber;

a gas injection member positioned on the band; and a gas outlet member positioned on the band and spaced from the gas injection member;

wherein the gas injection member and the gas outlet member are both in communication with the sound chamber, when the gas injection member is pressed, air enters into the sound chamber and the sound chamber expands to an expanded state; when the gas outlet member is pressed, the air is exhausted from the gas outlet member and the sound chamber restores to an original state.

2. The wearable electronic device of claim 1, wherein the band comprises a first wall and a second wall spaced apart from the first wall, the first wall and the second wall cooperatively form the sound chamber therebetween.

3. The wearable electronic device of claim 2, further comprising a loudspeaker, wherein the first wall defines a plurality of sound holes, the loudspeaker is positioned at an interior of the band and is aligned with the plurality of sound holes.

4. The wearable electronic device of claim 2, further comprising two loudspeakers positioned at an interior of the band, wherein the first wall defines two groups of sound holes, one loudspeaker corresponds to and is aligned with one group of the sound holes.

5. The wearable electronic device of claim 2, further comprising a dial, wherein the dial is embedded at a surface of the first wall.

6. The wearable electronic device of claim 5, wherein the dial comprises a display unit, the display unit is a touch panel.

7. The wearable electronic device of claim 1, wherein the band is made of an elastic material.

8. A wearable electronic device comprising:

a band defining a sound chamber and a plurality of sound holes;

a loudspeaker positioned at an interior of the band and aligned with the group of sound holes;

a gas injection member positioned on the band;

a gas outlet member positioned on the band and spaced from the gas injection member;

wherein the band is made of an elastic material, the gas injection member is configured to be pressed for allowing air to enter into the sound chamber so that the sound chamber expands to an expanded state, sound from the loudspeaker is spread in the expanded sound chamber and leaks from the group of sound holes; and the gad outlet member is configured to be pressed for allowing the air is exhausted from the gas outlet member and the sound chamber restored to an original state.

9. The wearable electronic device of claim 8, wherein the gas injection member is in communication with the sound chamber.

10. The wearable electronic device of claim 8, wherein the gas outlet member is communicated with the sound chamber.

11. The wearable electronic device of claim 8, wherein the band comprises a first wall and a second wall spaced apart from the first wall, the first wall and the second wall cooperatively form the sound chamber therebetween.

12. The wearable electronic device of claim 11, further comprising a dial, wherein the dial is embedded at a surface of the first wall.

13. The wearable electronic device of claim 12, wherein the dial comprises a display unit, the display unit is a touch panel.

* * * * *